US010888171B1

(12) United States Patent
Kinion

(10) Patent No.: US 10,888,171 B1
(45) Date of Patent: Jan. 12, 2021

(54) TILT BED TILTABLE EXTENSION

(71) Applicant: Gary Kinion, Farmington, AR (US)

(72) Inventor: Gary Kinion, Farmington, AR (US)

( * ) Notice: Subject to any disclaimer, the term of this patent is extended or adjusted under 35 U.S.C. 154(b) by 0 days.

(21) Appl. No.: 16/524,209

(22) Filed: Jul. 29, 2019

(51) Int. Cl.
*A47C 19/04* (2006.01)
*A47C 20/04* (2006.01)
*A47C 19/02* (2006.01)
*A61G 7/015* (2006.01)

(52) U.S. Cl.
CPC ..... *A47C 19/04* (2013.01); *A47C 19/021* (2013.01); *A47C 20/04* (2013.01); *A61G 7/015* (2013.01)

(58) Field of Classification Search
CPC ..... A47C 20/04; A47C 19/04; A47C 19/045; A47C 19/021; A61G 7/002; A61G 7/005; A61G 7/008; A61G 7/015; A61G 7/05
See application file for complete search history.

(56) References Cited

U.S. PATENT DOCUMENTS 4,387,873 A * 6/1983 Pavlo ..... A61M 5/1415 211/113
6,357,065 B1 * 3/2002 Adams ..... A47C 19/04 5/611
7,406,729 B2 * 8/2008 Hornbach ..... A47C 19/045 5/185
7,712,168 B2 * 5/2010 Kim ..... A61G 7/001 5/185
7,845,032 B2 * 12/2010 Chambers ..... A61G 7/05776 5/600
8,104,122 B2 * 1/2012 Richards ..... A61G 7/05 5/600
9,149,400 B2 * 10/2015 Serhan ..... A61G 7/002
9,622,927 B1 * 4/2017 Edgerton ..... A61G 7/002
9,757,293 B2 * 9/2017 Turner ..... A61G 7/015
10,130,536 B2 * 11/2018 Roussy ..... A61G 7/002
2005/0166323 A1 * 8/2005 Kawakami ..... A61G 7/001 5/610
2006/0117479 A1 * 6/2006 Kawakami ..... A61G 7/012 5/411
2006/0195986 A1 * 9/2006 Hakamiun ..... A61G 7/0514 5/600
2014/0047641 A1 * 2/2014 Thodupunuri ..... A61G 7/018 5/613

(Continued)

*Primary Examiner* — David R Hare
(74) *Attorney, Agent, or Firm* — Lymon Moulton, Esq.; Moulton Patents, PLLC

(57) ABSTRACT

A disclosed tilt bed includes a tilt base engineered to adjust around widthwise demarcations defining a plurality of tilt sections having a height dimension, the tilt base comprising lateral extension receiving hardware. At least one lateral extension is engineered to extend a width or a length of the tilt base and to adjust around interconnecting hinges and demarcate interconnected extension panels having a height equal to the height of the tilt sections. Extensible attachments are engineered on each extension panel to secure each extension panel to a respective bed tilt section via the extensible attachments received into the extension receiving hardware. A method includes securing the lateral extensions a distance from the tilt sections to expand the tilt base into a larger bed size including single, twin, full, queen and king and variations for length and width included. The tiltable base and the attached tiltable extensions are adjusted together.

19 Claims, 10 Drawing Sheets

(56) References Cited

U.S. PATENT DOCUMENTS

| | | | | |
|---|---|---|---|---|
| 2014/0215717 | A1* | 8/2014 | Rigsby | A61G 7/015 5/613 |
| 2015/0297432 | A1* | 10/2015 | Poulos | A61G 7/0513 5/610 |
| 2016/0220434 | A1* | 8/2016 | Li | A61G 7/015 |

* cited by examiner

TILT BED TILTABLE EXTENSION

BACKGROUND AND FIELD OF INVENTION

Bed frames for flat profile bases with sliding rails to fit multiple size beds are commonplace. The transition from a single to a twin and to a full can be made with larger side rails in a frame without the need for a center post required in a queen bed or in a king bed. However, bed frames for adjustable tilt beds are built to a specific bed size due to the complexity of the tilting frame and a user's preference for adjusting a back support, a hip support and leg rest.

Tilt beds avoid the drawbacks of conventional flat mattresses which are not very good at disturbing the body's weight. As a result, pressure hot spots develop along a sleeper's body. Sleepers toss and turn from one position to another, mainly to relieve these pressure points, which occur at various places along the body where one comes into contact with a mattress. If these pressure points could be alleviated or removed all together then a sleeper may be able to avoid tossing and turning during sleep and stay sleeping. Many people actually wake themselves from sleep as they reposition themselves to become more comfortable. This, obviously, is not conducive to sound sleep. It is therefore desirable that the body be relieved of the need to frequently change positions without actually having to be physically repositioned.

Some sleep experts have reported that the average person tosses and turns 40-60 times during the night. According to multiple scientific sleep studies, more than 70 million Americans may suffer from sleep disorders, such as acid reflux, inflammation, insomnia, sleep apnea, general stress related issues, toxicity, and other health related problems. Sleepers with these conditions experience difficulty initiating or maintaining sleep, often resulting in impaired daytime functioning. In one poll, 35 percent of all adults experienced sleep disorder symptoms every night, with 58 percent reporting insomnia at least a few nights per week. Additionally, more than 100 million Americans are, by definition, chronically sleep-deprived.

However, much of the bedding industry has sought to solve the problem of a body's weight bearing down on a flat, non-moving bed surface by either softening or contouring mattress surfaces. There are hundreds of inventive ideas in the prior art dealing with the improvement of the sleep surface but none have been found that seek to move the mattress in ways that preclude a sleeper from having to reposition themselves during sleep and offer therapeutic benefits at the same time.

SUMMARY OF THE INVENTION

A disclosed tilt bed includes a tiltable base engineered to adjust around widthwise demarcations defining a plurality of tilt sections having a height dimension, the tilt base comprising lateral extension receiving hardware. At least one lateral extension is engineered to extend a width or a length of the tilt base and to adjust around widthwise hinges and demarcate extension panels having a height equal to the height of the tilt sections. Extensible attachments are engineered on each extension panel to secure each extension panel to a respective bed tilt section via the extensible attachments received into the extension receiving hardware. A method includes securing the lateral extensions a distance from the tilt sections to expand the tilt base into a larger bed size including single, twin, full, queen and king and variations for length and width included. The tiltable base and the attached tiltable extensions are adjusted together.

Other aspects and advantages of embodiments of the disclosure will become apparent from the following detailed description, taken in conjunction with the accompanying drawings, illustrated by way of example of the principles of the disclosure.

Figure 1:
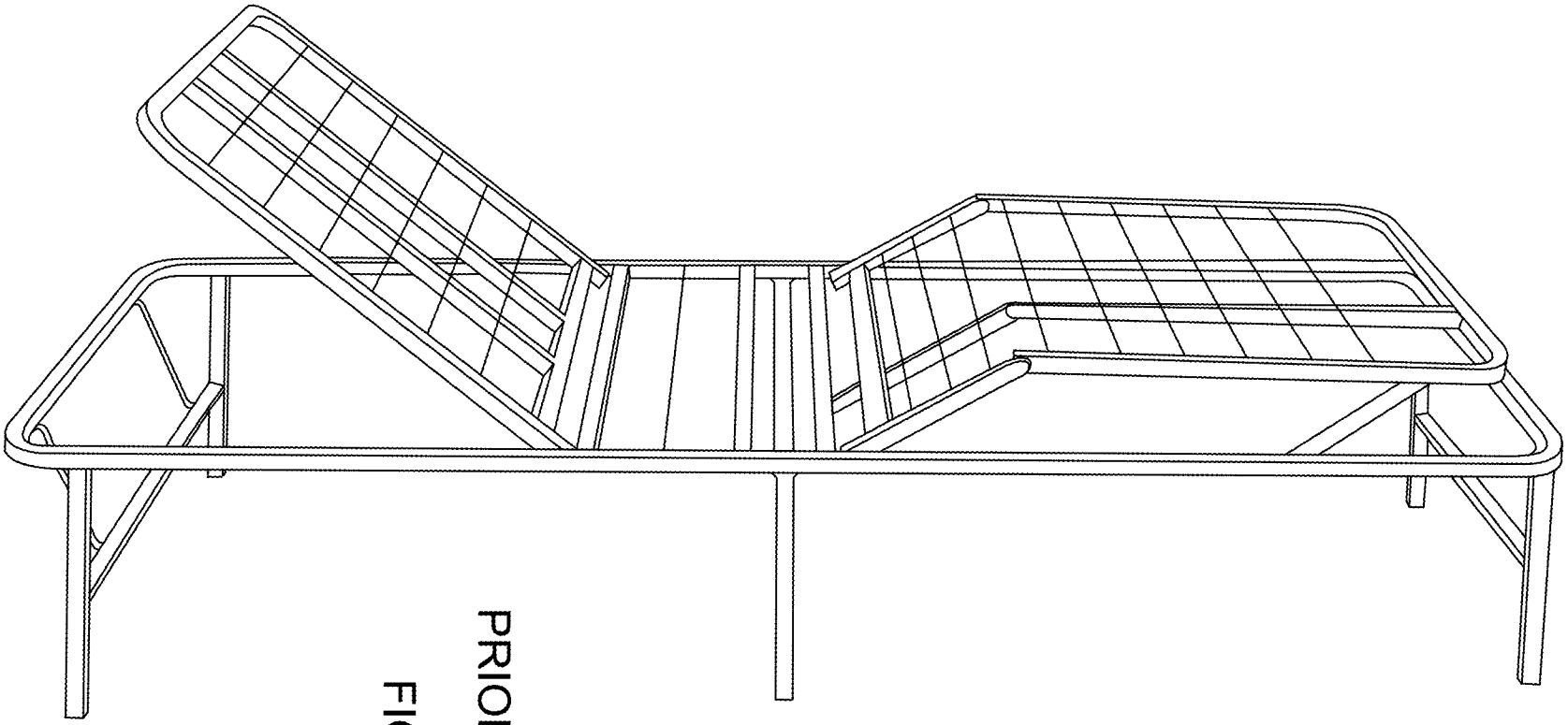
PRIOR ART FIG. 1
FIG. 1 is a perspective view of a prior art tilt bed depicting a tilt profile and tiltable bed base members for a twin bed.

Throughout the description, same and similar reference numbers may be used to identify same and similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

Throughout the present disclosure, the term 'tilt and tiltable' refer to an adjustable bed not unlike those in hospitals and in homes which allow a user to form a bed to a comfort profile for reading, resting and watching TV and laptop use. The term 'tilt base' refers throughout the disclosure to a platform and associated hardware and system for supporting a bedding mattress. The term hinge is synonymous with linkage. The term interconnecting is synonymous with contiguous.

FIG. 1 is a perspective view of a prior art tilt bed depicting a tilt profile and tiltable bed base members for a twin bed. The prior art depiction is intended to be exemplary of the prior art for adjustable profile tilt beds.

Figure 2:
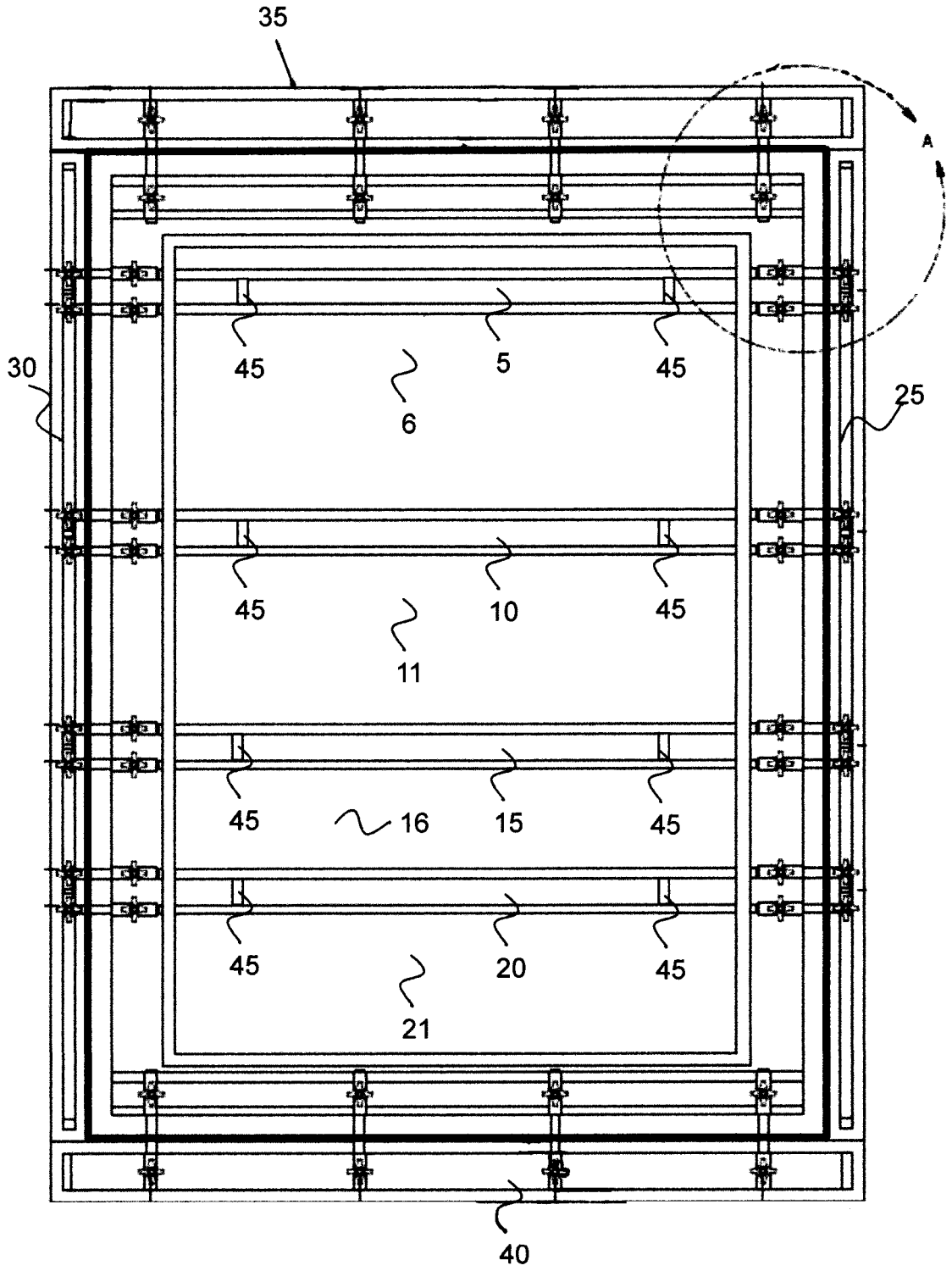
FIG. 2 is a bottom elevational view depicting a tilt bed and two lateral extensions and a head and a foot extension in a flat profile in accordance with an embodiment of the present disclosure.

FIG. 2 is a bottom elevational view depicting a tilt bed and two lateral extensions and a head and a foot extension in a flat profile in accordance with an embodiment of the present disclosure. The depiction includes the widthwise demarcations 5, 10, 15 and 20, the lateral extensions 25 and 30, the head extension 35 and the foot extension 40 and the tiltable hinges 45 which are detailed below in the disclosure. The extended tilt bed is a full to a queen extension but is exemplary of other extensions as discussed in the disclosure.

Figure 3:
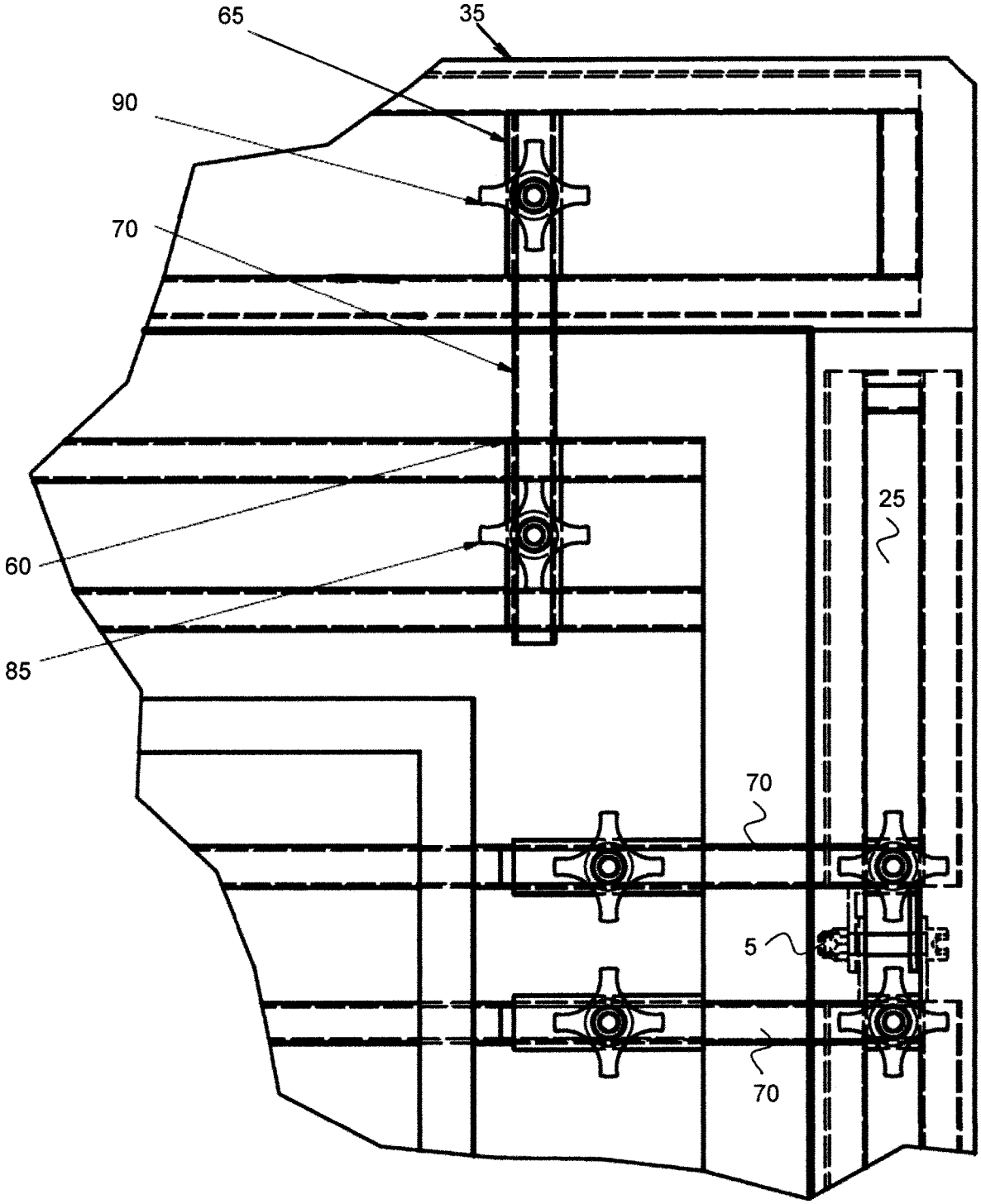
FIG. 3 is a close up view of the broken line area A of FIG. 2 showing a juncture of a lateral extension and a head extension in accordance with an embodiment of the present disclosure.

FIG. 3 is a close up view of the broken line area A of FIG. 2 showing a juncture of a lateral extension and a head extension in accordance with an embodiment of the present disclosure. The depiction includes the 90 degree perpendicular corner where a lateral extension 25 meets a head extension 35. The depiction includes extensible slider rods 70, the extensible attachment knobs 85 and 90, the extensible attachments 60 and 65 and the extension hinge 45. The depiction implicitly includes reference lines and numbers used in other drawings of the disclosure for similar and same limitations.

Figure 4:
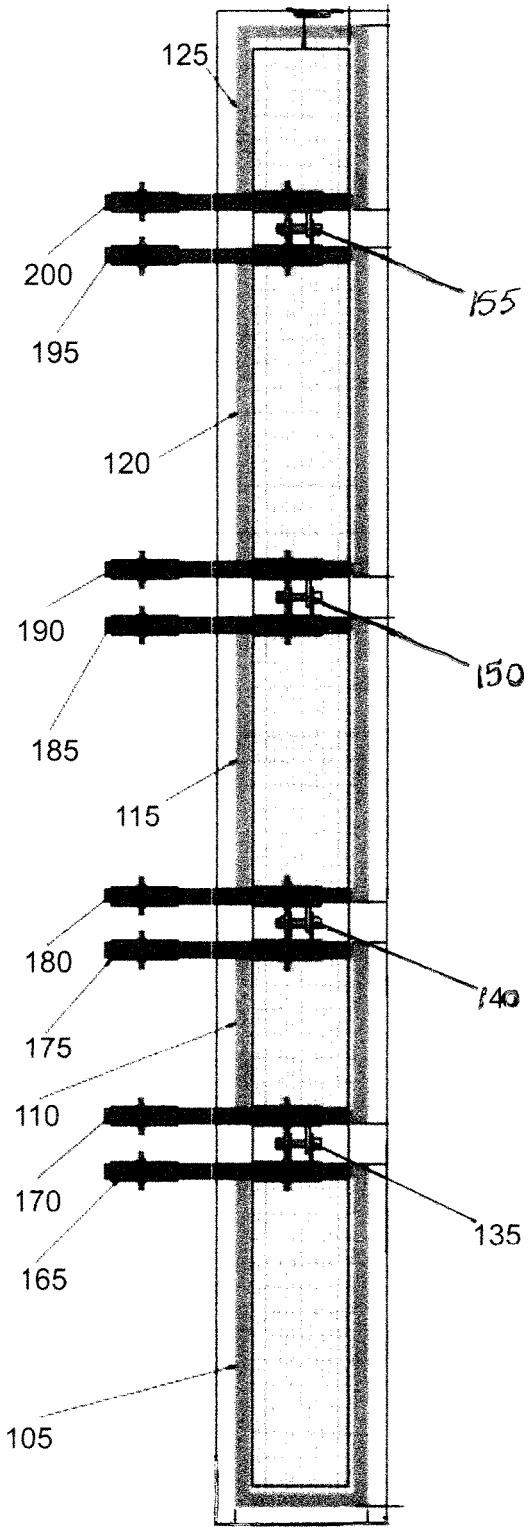
FIG. 4 is an elevational view of a tiltable lateral extension with panels and extensible attachment hardware in a flat profile in accordance with an embodiment of the present disclosure.

FIG. 4 is an elevational view of a tiltable lateral extension with panels and extensible attachment hardware in a flat profile in accordance with an embodiment of the present disclosure. The depiction includes the extension panels 105, 110, 115, 120 and 125 comprising a lateral extension by joinder via the tiltable hinges 135, 140, 150 and 155. The extensible attachments are shown extended to be received by hardware on the tilt bed segments or to attach to tilt bed segments demarcated at the same widthwise locations. The tiltable extensible attachments are in pairs 165 and 170, 175 and 180, 185 and 190, 195 and 200.

Figure 5:
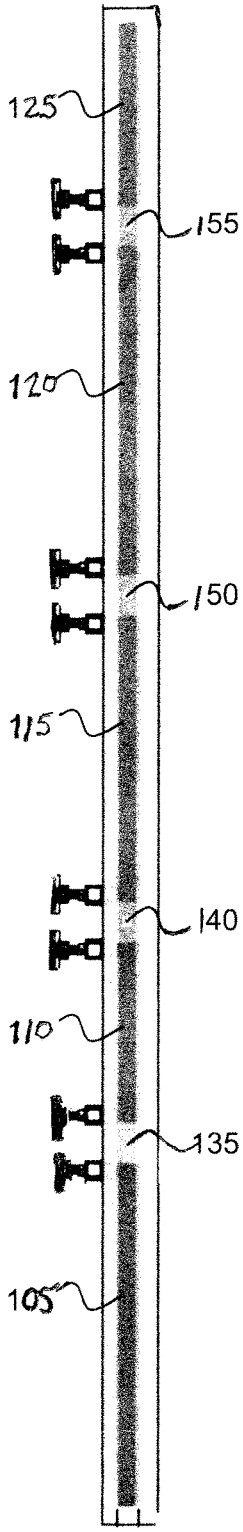
FIG. 5 is a side elevational view of a tiltable lateral extension with panels and extensible attachment hardware in a flat profile in accordance with an embodiment of the present disclosure.
Figure 6:
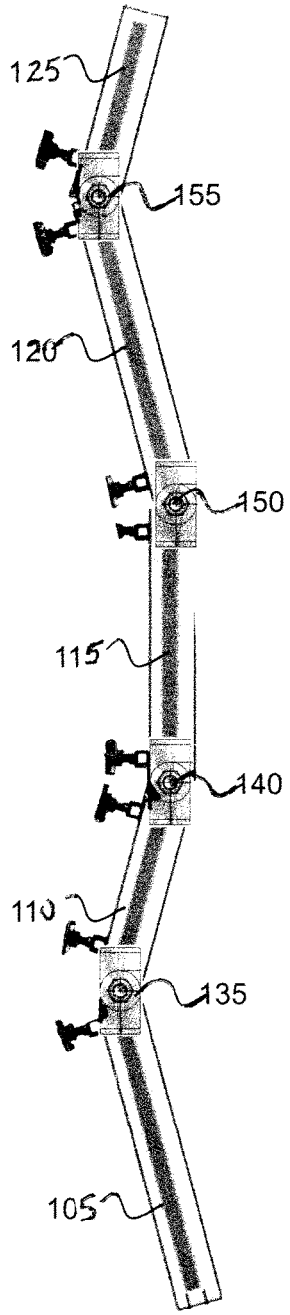
FIG. 6 is a side elevational view of a tiltable lateral extension with panels and extensible attachment hardware in a tilted profile in accordance with an embodiment of the present disclosure.

FIG. 5 is a side elevational view of a tiltable lateral extension with panels and extensible attachment hardware in a flat profile in accordance with an embodiment of the present disclosure. The flat profile is adjustable into the tilted profile as depicted in FIG. 6. The hinges 135, 140, 150 and 155 are hidden within the profile of the respective extension panels 105, 110, 115, 120 and 125.

FIG. 6 is a side elevational view of a tiltable lateral extension with panels and extensible attachment hardware in a tilted profile in accordance with an embodiment of the present disclosure. The tiled profile is adjustable into other tilted profiles as desired by a user of the extension tilt bed as disclosed. The hinges 135, 140, 150 and 155 include ratcheting positions for temporary locking of the extension panels 105, 110, 115, 120 and 125 in embodiments of the disclosure.

Figure 7:
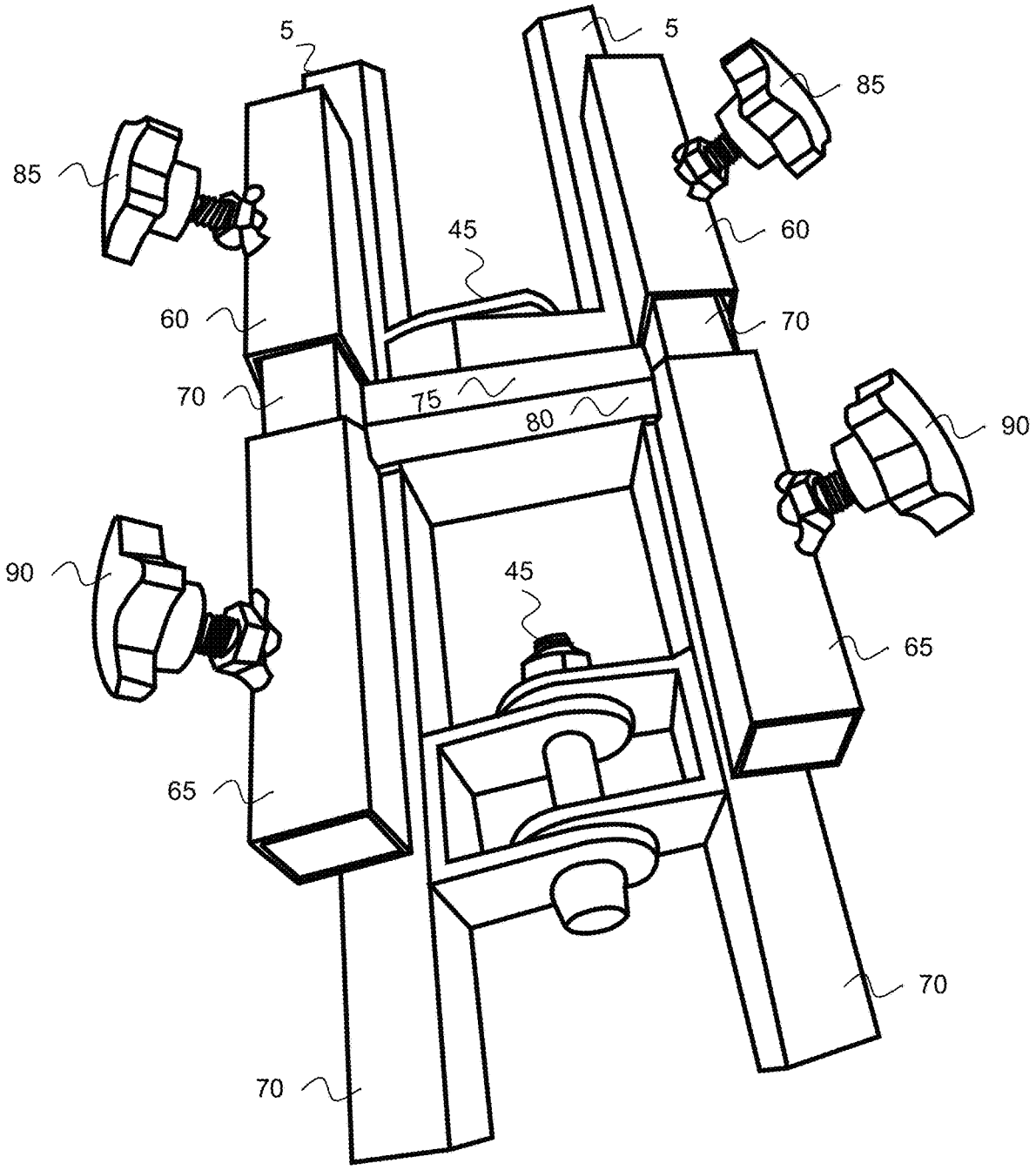
FIG. 7 is a perspective view of the extensible attachments on a tiltable bed segment secured to two extension panels with a tiled hinge in accordance with an embodiment of the present disclosure.

FIG. 7 is a perspective view of the extensible attachments on a tiltable bed segment secured to two extension panels with a tiled hinge in accordance with an embodiment of the present disclosure. The depiction includes the widthwise structure 5 in the tilt bed segments, the tilt bed framing of the extensible attachments 60, the extension panel framing of the extensible attachments 65, an extension rod or tubbing 70, the extension panel structure or frame 70, the tilt bed segment edge 75, the abutting extension panel edge 80, the tilt bed extensible knobs 85 and the extension panel securing knobs 90. The hinges 45 allow the tiltable bedbase and lateral extensions to adjust along several widthwise hinges demarcating tilt sections in a tilt profile.

Figure 8:
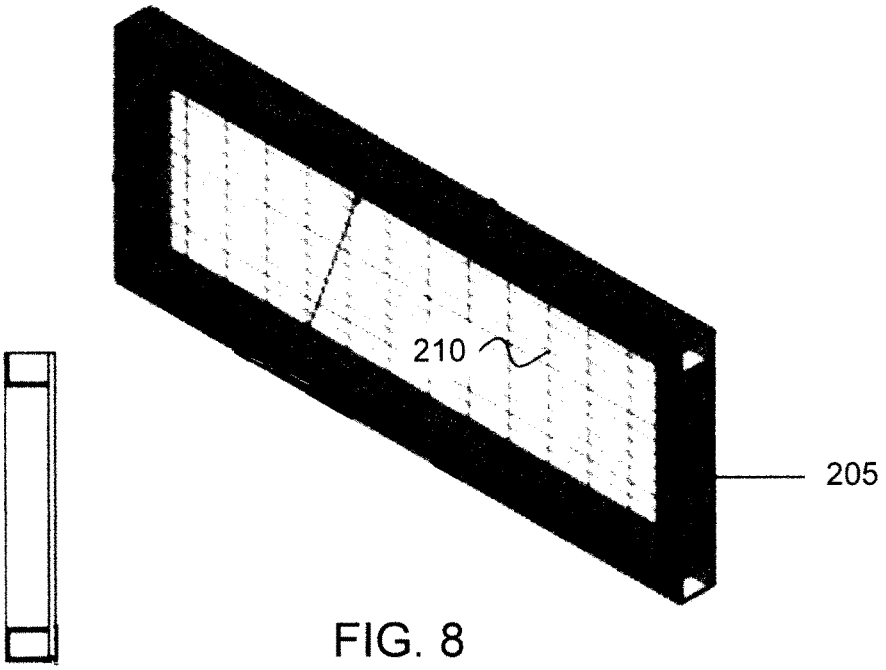
FIG. 8 is a perspective depiction of an extension panel with frame and wire mesh webbing in accordance with an embodiment of the present disclosure.

FIG. 8 is a perspective depiction of an extension panel with frame and wire mesh webbing in accordance with an embodiment of the present disclosure. The wire mesh webbing 210 covers a side of the extension panel to support a mattress thereon. The frame 205 comprises channel material and also includes tubbing and wood composite and plastics in embodiments. Other materials and method including but limited to plywood and wooden or metal slats are also used to support a mattress on the extension panel frame.

Figure 9:
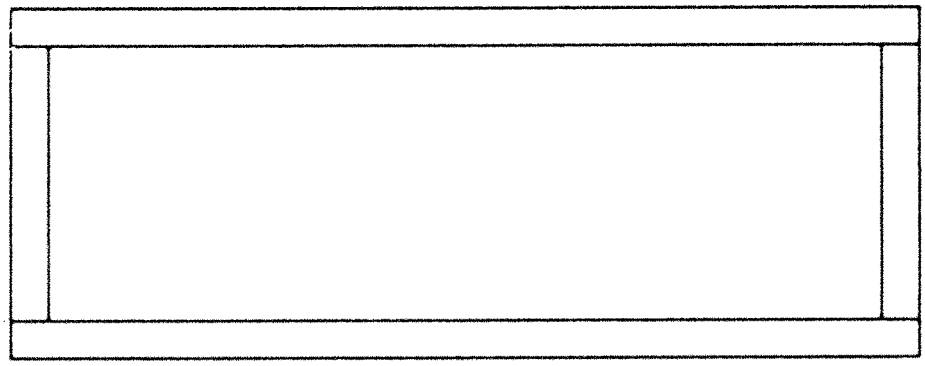
FIG. 9 is top elevational view of an extension panel frame in accordance with an embodiment of the present disclosure.

FIG. 9 is top elevational view of an extension panel frame in accordance with an embodiment of the present disclosure. Dimensions vary according to tilt bed segment dimensions, particularly height and matching height extension panels.

Figure 10:
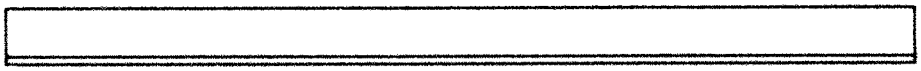
FIG. 10 is a side elevational view of an extension panel frame in accordance with an embodiment of the present disclosure.

FIG. 10 is a side elevational view of an extension panel frame in accordance with an embodiment of the present disclosure. Dimensions vary according to tilt bed segment dimensions, particularly height and matching height extension panels.

Figure 11:
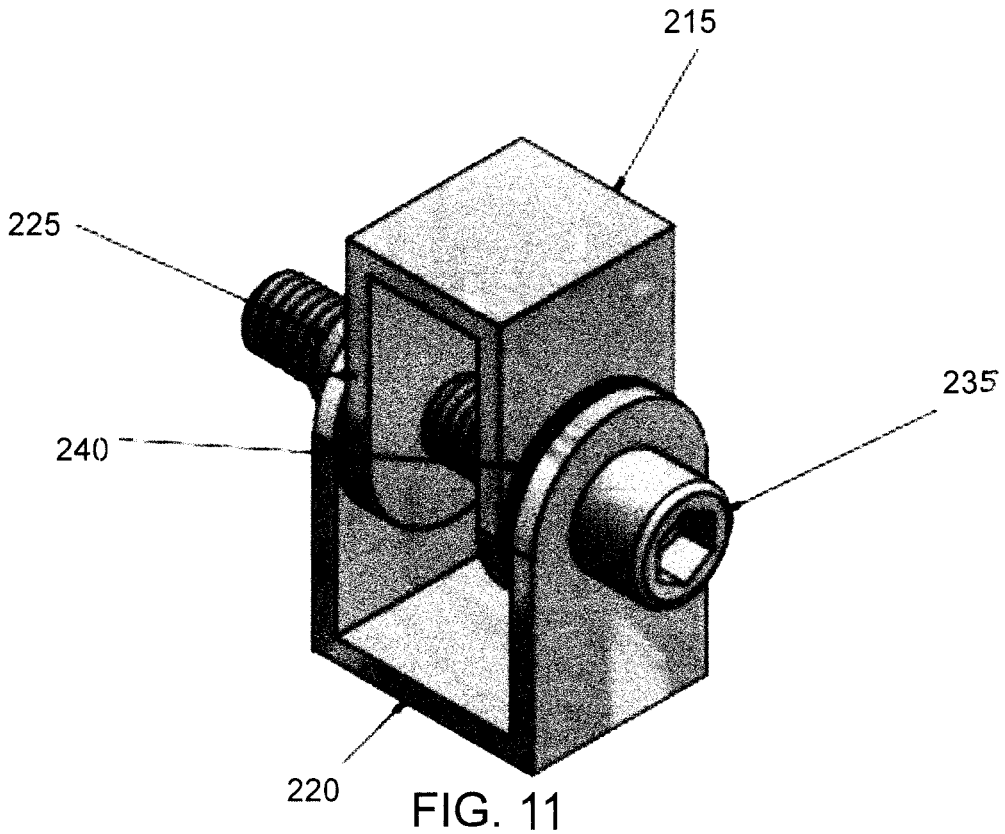
FIG. 11 is a perspective view of tiltable extension panel hinge in accordance with an embodiment of the present disclosure.

FIG. 11 is a perspective view of tiltable extension panel hinge in accordance with an embodiment of the present disclosure. The depiction includes a first U shaped bracket 215, a second U shaped bracket 220, a pivot nut 225, a pivot bolt 235 and washers 240. A "U" shaped pivot attachment bracket is employed to attach the two separate panels or tilt bed segments together. This bracket may consist of two separate "U" shaped stainless steel or galvanized metal brackets affixed together by way of a single shoulder bolt and washers made from a plastic, ceramic, rubber or any other material to cause any pivoting motion produced to be very silent when in motion. Other methods of attachment such as a swing arm of some type, rubber attachment devices also provide a swivel or hinging type effect and so on.

The "U" shaped coupling brackets are made from standard stainless steel, galvanized steel brackets or any other durable substance in various sundry shapes and sizes either welded, bolted or affixed securely in any way to the above item or structure to be rocked. A typical U-shaped pivot coupling bracket or hinge with cushioning plastic washers is used for the purpose of suppressing noise and extending the life of the coupling mechanism. Notice bolts to lock the two parts of the coupling together and, thus providing a coupling to enable the platform above. The bracket part is the second part of the pivot coupling bracket that completes the connection of any two items being attached. Both brackets as attached to their respective items can be welded at their points of contact with their counterparts, bolted on or affixed in any other method so as to complete the connection of said items in a safe and stable manner.

Embodiments of the disclosure also include a plurality of independent extensible attachments which comprise 'C' clamps with knobbed securing bolts on each side of each clamp. The 'C' clamps attach onto an after market tilt bed or onto receiving hardware on a tilt bed engineered to the lateral extensions. The tilt bed base is also joined by an aftergirded assembly of legs, headboard, footboard and even a motor to assist in the tild adjustments.

Figure 12:
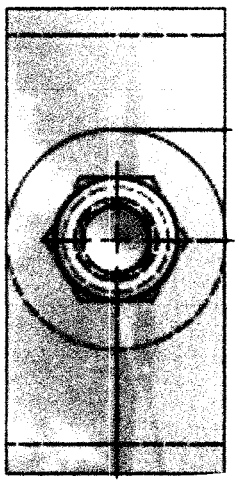
FIG. 12 is an end elevational view of the tiltable extension panel hinge in accordance with an embodiment of the present disclosure.

FIG. 12 is an end elevational view of the tiltable extension panel hinge in accordance with an embodiment of the present disclosure. The pivot bolt 235 is shown in hexagonal socket but is also implemented in slotted and other sockets.

Figure 13:
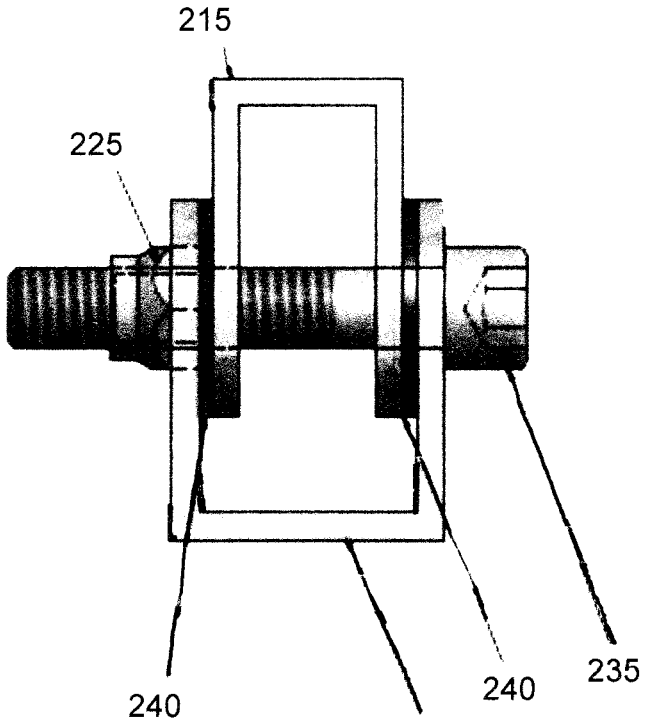
FIG. 13 is a top elevational view of the tiltable extension panel hinge in accordance with an embodiment of the present disclosure.

FIG. 13 is a top elevational view of the tiltable extension panel hinge in accordance with an embodiment of the present disclosure. The depiction includes a first U shaped bracket 215, a second U shaped bracket 220, a pivot nut 225, a pivot bolt 235 and washers 240. The U shaped hinges of the lateral extensions are similar to the U shaped hinges of the tiltable bed base. Also, adjacent U shaped hinges are similar to the function and dimensions of center and outside U shaped hinges and are interchangeable.

Figure 14:
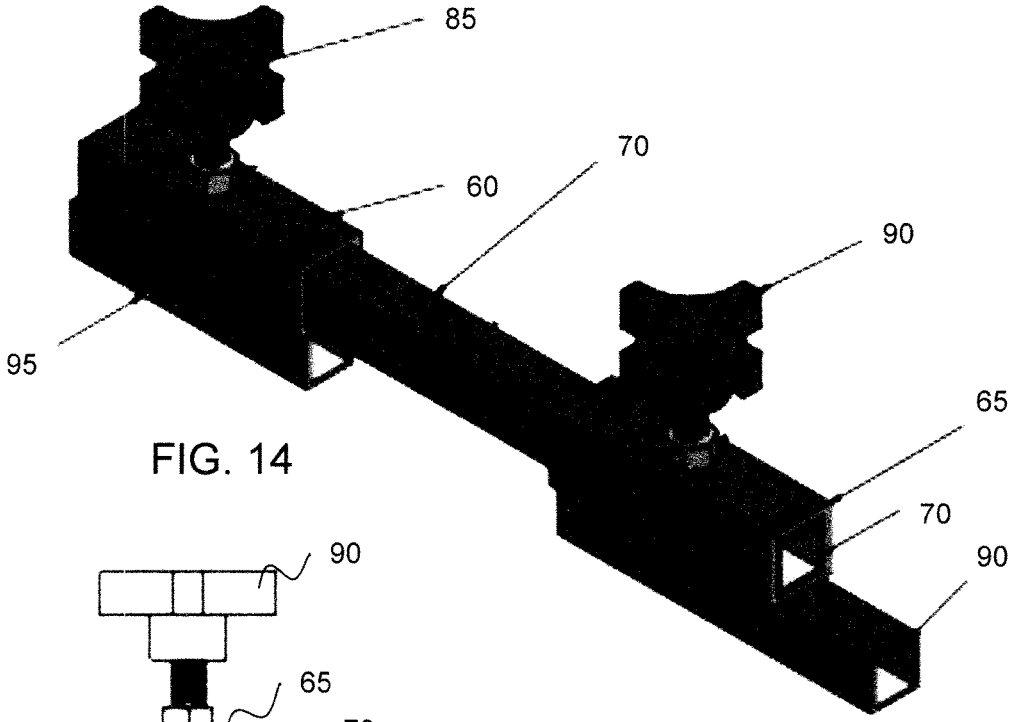
FIG. 14 is a perspective view of the extensible attachment hardware configured to secure the tiltable base to the tiltable extension panels in accordance with an embodiment of the present disclosure.

FIG. 14 is a perspective view of the extensible attachment hardware configured to secure the tiltable base to the tiltable extension panels in accordance with an embodiment of the present disclosure. The depiction includes a single extensible attachment including the extensible receiver 65, the tilt bed segment receiver 60, an extension rod or tubbing 70, the extension offsets 90 and 95, the tilt bed extensible knobs 85 and the extension panel securing knobs 90.

Figure 15:
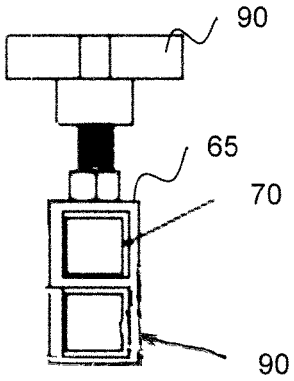
FIG. 15 is an end elevational view of the extensible attachment hardware in accordance with an embodiment of the present disclosure.

FIG. 15 is an end elevational view of the extensible attachment hardware in accordance with an embodiment of the present disclosure. The depiction shows the extension rod or tubbing 70 received into the extensible receiver 65. Also shown are the securing knob 90 and the extension offset 90.

Figure 16:
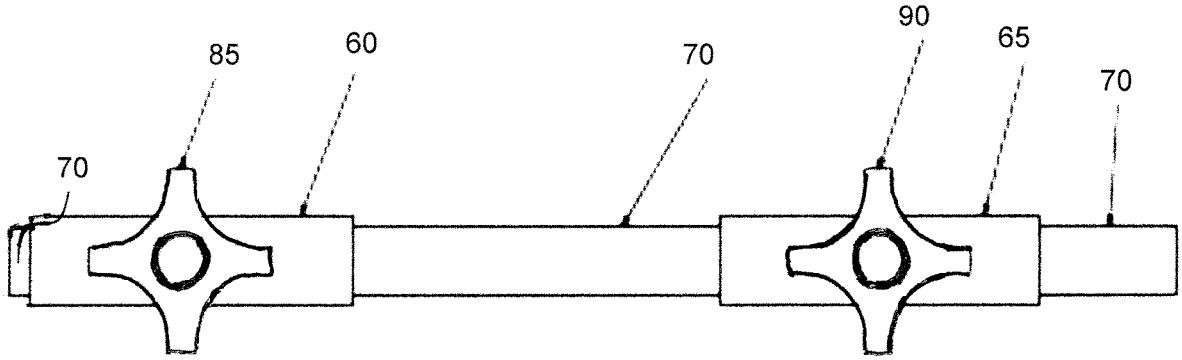
FIG. 16 is an elevational view of the extensible attachment hardware in accordance with an embodiment of the present disclosure.

FIG. 16 is an elevational view of the extensible attachment hardware in accordance with an embodiment of the present disclosure. The depiction includes a single extensible attachment including the extensible receiver 65, the tilt bed segment receiver 60, an extension rod or tubbing 70, the extension offsets 90 and 95, the tilt bed extensible knobs 85 and the extension panel securing knobs 90.

Figure 17:
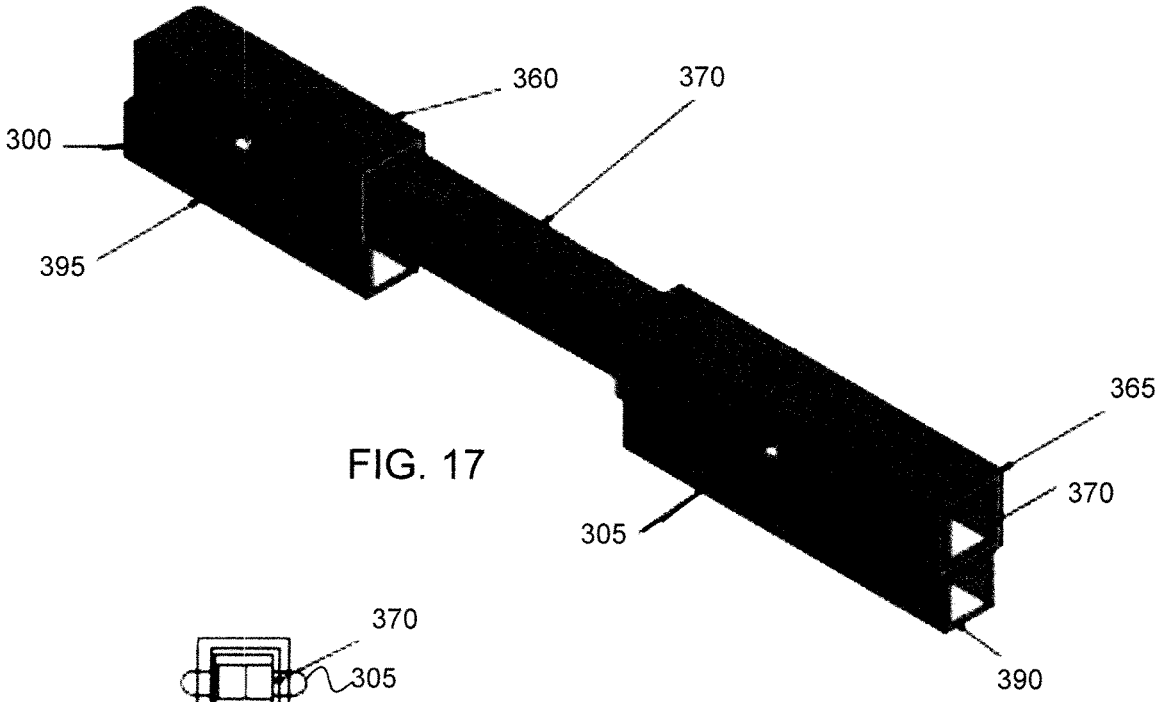
FIG. 17 is a perspective view of a spring lock button extensible attachment hardware in accordance with an embodiment of the present disclosure.

FIG. 17 is a perspective view of a spring clip lock button extensible attachment hardware in accordance with an embodiment of the present disclosure. The depiction includes a single extensible attachment including the extensible receiver 365, the tilt bed segment receiver 360, an extension rod or tubing 370, the extension offsets 390 and 395, the tilt bed extensible knobs 385 and the extension panel securing knobs 390 and the lock buttons 300 and 305.

Figure 18:
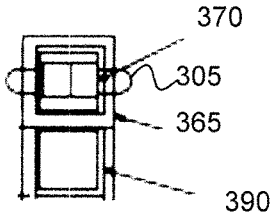
FIG. 18 is an end elevational view of the spring lock button extensible attachment hardware in accordance with an embodiment of the present disclosure.

FIG. 18 is an end elevational view of the spring clip button extensible attachment hardware in accordance with an embodiment of the present disclosure. The depiction includes the extensible receiver 365, the extension rod or tubing 370, the lock button 305 and the extension offset 390.

Figure 19:
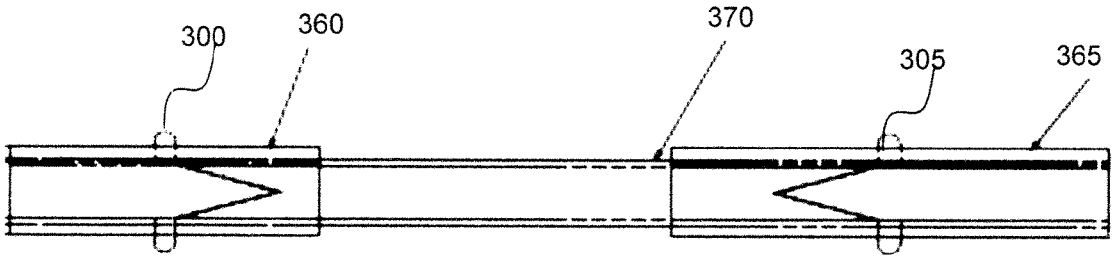
FIG. 19 is an elevational view of the spring clip button extensible attachment hardware in accordance with an embodiment of the present disclosure.

FIG. 19 is an elevational view of the spring clip button extensible attachment hardware in accordance with an embodiment of the present disclosure. The depiction includes a single extensible attachment including the extensible receiver 365, the tilt bed segment receiver 360, an extension rod or tubbing 370, the extension offsets 390 and 395, the tilt bed extensible knobs 385 and the extension panel securing knobs 390 and the lock buttons 300 and 305.

Figure 20:
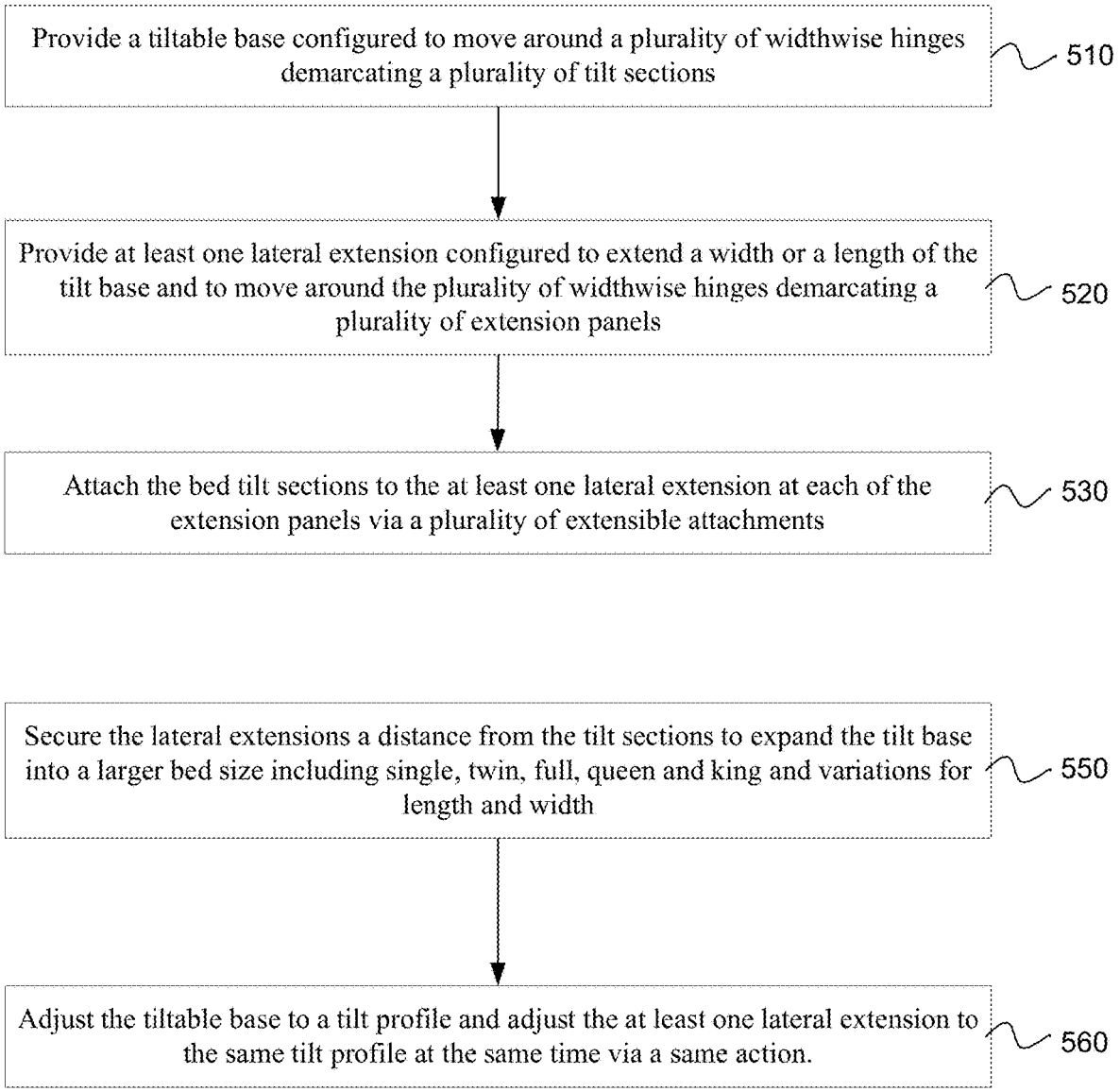
FIG. 20 is a flow chart of a tilt bed method for extending a size of a tilt bed in accordance with an embodiment of the present disclosure.

FIG. 20 is a flow chart of a tilt bed method for extending a size of a tilt bed in accordance with an embodiment of the present disclosure. The method includes providing 510 a tilt base configured to move around a plurality of widthwise demarcations defining a plurality of tilt sections comprising a tilt profile in use. The method also includes providing 520 at least one lateral extension configured to extend a width or a length of the tilt base and to move around the plurality of widthwise hinges demarcating a plurality of extension panels matching the tilt profile. The method additionally includes attaching 530 the bed tilt sections to the at least one lateral extension at each of the extension panels via a plurality of extensible attachments. The method further includes securing 550 the lateral extensions a distance from the tilt sections to expand the tilt base into a larger bed size including single, twin, full, queen and king and variations for length and width included. The method yet includes adjusting 560 the tiltable base to a tilt profile and adjusting the at least one lateral extension to the same tilt profile at the same time via a same action.

Embodiments of the disclosure include a single bed tiltable base, which together with the at least one lateral extension comprise a twin tilt bed. A twin bed tiltable base together with the at least one lateral extension comprise a full tilt bed. A twin bed tiltable base wherein the at least one lateral extension is another twin bed tiltable base together comprise a king tilt bed. A left and a right lateral extension on a queen tilt bed make a king tilt bed. A queen bed tiltable base with the at least one lateral extension comprise an olympic queen tilt bed. A king bed tiltable base with the at least one lateral extension comprise a California king tilt bed. A queen bed tiltable base with the at least one lateral extension comprise a California queen tilt bed. A twin extra-long tiltable base with the at least one lateral extension comprises a full extra-long tilt bed. A full extra-long tiltable base with the at least one lateral extension comprises a queen tilt bed. A full tiltable base with a 5 inch extension on a head or a foot of the full tiltable base comprises a queen tilt bed.

An embodiment of the present disclosure allows the user to simply attach the lateral extensions to any bed size including a single, twin, queen, king and consumer variations thereof. This allows the user the benefits of the disclosure without the need to buy a complete system of bed base and the lateral extensions. The disclosure works well with Sealy Posturpedic, Sleep Number, Serta, Simmons, Pillow top, Denver Mattress Company, Leggett and Platt, as well as every other commercially available mattress brands.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A tilt bed, comprising:

a) a tiltable base configured to adjust along a plurality of widthwise demarcations defining a plurality of tilt sections comprising a tilt profile in use;

b) at least one tiltable lateral extension configured to extend a width or a length of the tiltable base and to adjust along a plurality of interconnecting hinges demarcating a plurality of interconnected extension panels matching the tilt profile; and c) a plurality of independent extensible attachments configured to secure the bed tilt sections to the at least one lateral extension at each of the extension panels, wherein the plurality of independent extensible attachments comprise 'C' clamps with knobbed securing bolts on each side of each clamp.

2. The tilt bed of claim 1, wherein the plurality of extension panels each comprise a tubular frame and a wire mesh webbing and a resting surface for a mattress on the bed tiltable base.

3. The tilt bed of claim 1, wherein the tiltable base is a single bed tiltable base and together with the at least one lateral extension comprise a twin tilt bed.

4. The tilt bed of claim 1, wherein the tiltable base is a twin bed tiltable base and together with the at least one lateral extension comprise a full tilt bed.

5. The tilt bed of claim 1, wherein the tiltable base is a twin bed tiltable base and the at least one lateral extension is another twin bed tiltable base and together comprise a king tilt bed.

6. The tilt bed of claim 1, wherein the at least one lateral extension is a left and a right lateral extension to make a queen tilt bed into a king tilt bed.

7. The tilt bed of claim 1, wherein the tiltable base is a queen bed tiltable base and together with the at least one lateral extension comprise an olympic queen tilt bed.

8. The tilt bed of claim 1, wherein the tiltable base is a king bed tiltable base and together with the at least one lateral extension comprise a California king tilt bed.

9. The tilt bed of claim 1, wherein the tiltable base is a queen bed tiltable base and together with the at least one lateral extension comprise a California queen tilt bed.

10. The tilt bed of claim 1, wherein the tiltable base is a twin tiltable base and together with the at least one lateral extension comprises a full extra-long tilt bed.

11. The tilt bed of claim 1, wherein the tiltable base is a full tiltable base and together with the at least one lateral extension comprises a queen tilt bed.

12. The tilt bed of claim 1, wherein the tiltable base is a full tiltable base and together with a 5 inch extension on a head or a foot of the full tiltable base comprises a queen tilt bed.

13. The tilt bed of claim 1, wherein the plurality of independent extensible attachments comprise a plurality of spring steel lock buttons and receiving holes defined in telescoping channels.

14. The tilt bed of claim 1, wherein the plurality of interconnecting hinges comprise a U-shaped pivot coupling bracket including an inside bracket, an outside bracket, an adjacent bracket and a center pivot bolt.

15. The tilt bed of claim 1, further comprising an undergirding frame and attachments for a head board and a foot board in connection with the tilt base.

16. A tilt bed method, comprising:

a) providing a tilt base configured to move around a plurality of widthwise demarcations defining a plurality of tilt sections comprising a tilt profile in use;

b) providing at least one lateral extension configured to extend a width or a length of the tilt base and to move around a plurality of interconnecting hinges demarcating a plurality of interconnected extension panels matching the tilt profile; and c) attaching the tilt sections to the at least one lateral extension at each of the extension panels via a plurality of independent extensible attachments, wherein the plurality of independent extensible attachments comprise 'C' clamps with knobbed securing bolts on each side of each clamp.

17. The tilt bed method of claim 16, further comprising securing the lateral extensions a distance from the tilt sections to expand the tilt base into a larger bed size including single, twin, full, queen and king and variations for length and width included.

18. The tilt bed method of claim 16, further comprising adjusting the tiltable base to a tilt profile and adjusting the at least one lateral extension to the same tilt profile at a same time via a same action.

19. A tilt bed comprising:

a) a tilt base configured to move around a plurality of widthwise demarcations defining a plurality of tilt sections comprising a tilt profile and having a height dimension, the tilt base comprising a plurality of lateral extension receiving hardware;

b) at least one lateral extension configured to extend a width or a length of the tilt base and to move around a plurality of interconnecting hinges and demarcate a plurality of interconnected extension panels matching the tilt profile and having a total height equal to the height of the tilt sections; and c) a plurality of extensible attachments configured on each extension panel configured to secure each extension panel to a respective bed tilt section via the extensible attachments received into the extension receiving hardware, wherein the plurality of extensible attachments comprise 'C' clamps with knobbed securing bolts on each side of each clamp.

* * * * *